US007932690B2

(12) United States Patent
Jones et al.

(10) Patent No.: US 7,932,690 B2
(45) Date of Patent: Apr. 26, 2011

(54) WALL SAVER

(76) Inventors: Robert Dion Jones, New Port Richey, FL (US); Roy John Cracknell, Spring Hill, FL (US)

( * ) Notice: Subject to any disclaimer, the term of this patent is extended or adjusted under 35 U.S.C. 154(b) by 417 days.

(21) Appl. No.: 12/135,228

(22) Filed: Jun. 9, 2008

(65) Prior Publication Data

US 2009/0200977 A1 Aug. 13, 2009

Related U.S. Application Data

(60) Provisional application No. 61/065,217, filed on Feb. 11, 2008.

(51) Int. Cl.
*G08G 1/16* (2006.01)

(52) U.S. Cl. ..... 318/563; 318/566; 318/468; 318/466; 701/301; 5/86.1; 5/84.1; 5/616; 5/618; 5/600

(58) Field of Classification Search ..... 318/468, 318/466, 563, 566; 5/616, 618, 600, 81 R, 5/86.1; 701/301
See application file for complete search history.

(56) References Cited

U.S. PATENT DOCUMENTS 3,697,846 A * 10/1972 Mueller ..... 318/544
3,728,606 A * 4/1973 Finnegan et al. ..... 318/480
3,993,940 A * 11/1976 Volk, Jr. ..... 318/747
4,159,496 A * 6/1979 Stevens ..... 361/1
4,425,673 A * 1/1984 Werner ..... 5/611
6,601,251 B2 * 8/2003 Paul ..... 5/611
7,383,107 B2 * 6/2008 Fehr et al. ..... 701/25
7,406,731 B2 * 8/2008 Menkedick et al. ..... 5/618
7,506,390 B2 * 3/2009 Dixon et al. ..... 5/713
7,520,006 B2 * 4/2009 Menkedick et al. ..... 5/618
7,703,158 B2 * 4/2010 Wilker et al. ..... 5/616
2004/0021439 A1 * 2/2004 Porat et al. ..... 318/567
2006/0102392 A1 * 5/2006 Johnson et al. ..... 180/19.1
2008/0201847 A1 * 8/2008 Menkedick et al. ..... 5/600

* cited by examiner

*Primary Examiner* — Rita Leykin
(74) *Attorney, Agent, or Firm* — Dennis G LaPointe

(57) ABSTRACT

A system and associated method for preventing damage to an adjacent wall surface of an electrically operated bed that utilizes a normally closed/momentarily open switch assembly attached to the bed frame at a location such that when the bed fame is maneuvered toward an adjacent wall surface, a head of the switch contacts the wall surface before any other part of the bed frame or a proximity sensor switch is activated when the switch head is in the prescribed range from the wall surface. The push button switch is in electrical communication with the bed frame operational circuitry. When the switch activated from its depression from thw all surface contact or its proximity to the wall surface, the electrical circuitry in the system circuitry is interrupted thereby stopping the operation of the bed frame from being maneuvered and preventing damage to the wall surface.

8 Claims, 6 Drawing Sheets

WALL SAVER

RELATED APPLICATION

This application claims the benefit of U.S. provisional patent application Ser. No. 61/065,217 filed Feb. 11, 2008.

FIELD OF THE INVENTION

The invention relates to a device for preventing adjacent wall damage when electrically operating a bed, such as a hospital bed, including elevating and lowering of the bed as a whole or the head or foot portions of the bed.

BACKGROUND OF THE INVENTION

Hospital room walls behind beds are commonly in constant need of repair do to the beds being pushed too close to the wall, then raised or lowered. The bumpers supplied with the beds are not adequate enough and sometimes tear into the walls themselves. Much of the damage is caused because the person operating the bed does not see the bumper come in contact with the adjacent wall yet continues to elevate or lower the bed without realizing the damage being done to the wall surface.

With increase in technology, electric hospital beds are becoming more affordable, resulting in an increased amount of electric beds being utilized in hospitals, nursing homes, skilled nursing facilities and in some cases assisted living facilities. With this growth there has been a major development plaguing the maintenance staff of these facilities. All such beds have the ability to be adjusted in height to better suit the resident's needs. Some of these beds are called "high/low beds" which will set all the way down to the floor for the residents that are at risk for falling. Very few, if any, of these electric beds raise or lower in a completely vertical motion. They all have a horizontal motion, though slight on some, and more on others, which causes the problem of adjacent wall damage.

Repair to the walls is a constant issue and obviously costly. Once the joint compound is applied and sanded for painting, the wall is painted and must be allowed to dry before the bed can be placed back in position. This can take a 3-5 hour period depending on the repair depth. In some cases, a section of wallboard needs to be removed and replaced for a proper repair and this takes extra time. Unfortunately, in many cases, a wall can be repeatedly repaired due to the reoccurrence of damage.

What is needed is a device that after contact with the wall, can shut off the power to the bed operating circuit so lowering or elevating can stop and can not continue until the bed is pulled away from the adjacent wall so as to complete the lifting or lowering operation.

SUMMARY OF THE INVENTION

The invention is an electrical device, which is attached to any electric hospital or health care bed. The device may be operated from a DC or AC power source. The device or system includes a switch box which is attached to the corner of the head of the bed in place of the small rubber bumper that is normally supplied with any standard hospital electric bed. Alternative locations may be a preferred attachment point depending on the original design of the bed frame. That is, it can also be installed in the general area of the rubber bumper as long as it a location that when the electrical hospital bed is maneuvered toward the adjacent wall surface, the push button will contact the wall surface before any other part of the hospital bed, including the rubber bumper. Instead of a push button type of power interruption device, an alternative switch is a proximity sensor switch that senses when the frame is too close to the wall and the power to the bed frame operating controls are interrupted to stop maneuvering of the bed frame.

In one embodiment, the box includes an outlet receptacle electrically connecting the hospital bed electrical plug and an in-line surge protector, if desired. In other embodiments, the power may be connected directly into control panel. The box acts as a push button switch (or proximity sensor switch) where the internal circuitry, which is in electrical communication with the AC power supply of the hospital room and the hospital bed electrical operating system, is wired so that there is a normally closed/momentary open switch on the box.

The button or sensor faces the wall on which the head of the bed is positioned against or adjacent to. When the bed is pushed too close to the wall, the button is pressed in (or the sensor is activated) and the power to the bed is interrupted, that is, temporarily shut off. When the bed is pulled away from the wall far enough to release the button or reset the sensor switch, the power is supplied again and the bed resumes its full function ability, thereby preventing damage to the wall.

In summary therefore, the invention is a method and its related system with its circuitry for preventing damage to an adjacent wall surface of an electrically operated bed comprising attaching a normally closed/momentarily open switch assembly to bed frame at a location such that when the bed frame is maneuvered or urged toward an adjacent wall surface, a head of a push button switch mounted in the assembly contacts the wall surface before any other part of the hospital bed frame or a sensor acknowledges an object within the prescribed sensor distance before any other part of the bed frame is able to contact the adjacent wall surface. The switch is in electrical communication with a controller, a motor and a control panel typically associated with the bed frame and is further in electrical communication with an electrical power source, which can be an AC power source from a nearby wall outlet or alternatively a DC power source, if desired. When the head of the push button switch is depressed from the contact with the wall surface, the electrical communication with the controller, motor and panel is interrupted thereby stopping the bed frame from being maneuvered any further and thereby preventing damage to the wall surface. Similarly, when the head of the sensor switch is activated when the distance to the wall surface is within the prescribed sensor range, the electrical communication with the controller, motor and panel is interrupted thereby stopping the bed frame from being maneuvered any further and thereby preventing damage to the wall surface. Preferably, the head of the push button switch should be a spring return mushroom head.

DETAILED DESCRIPTION OF THE INVENTION

Figure 1:
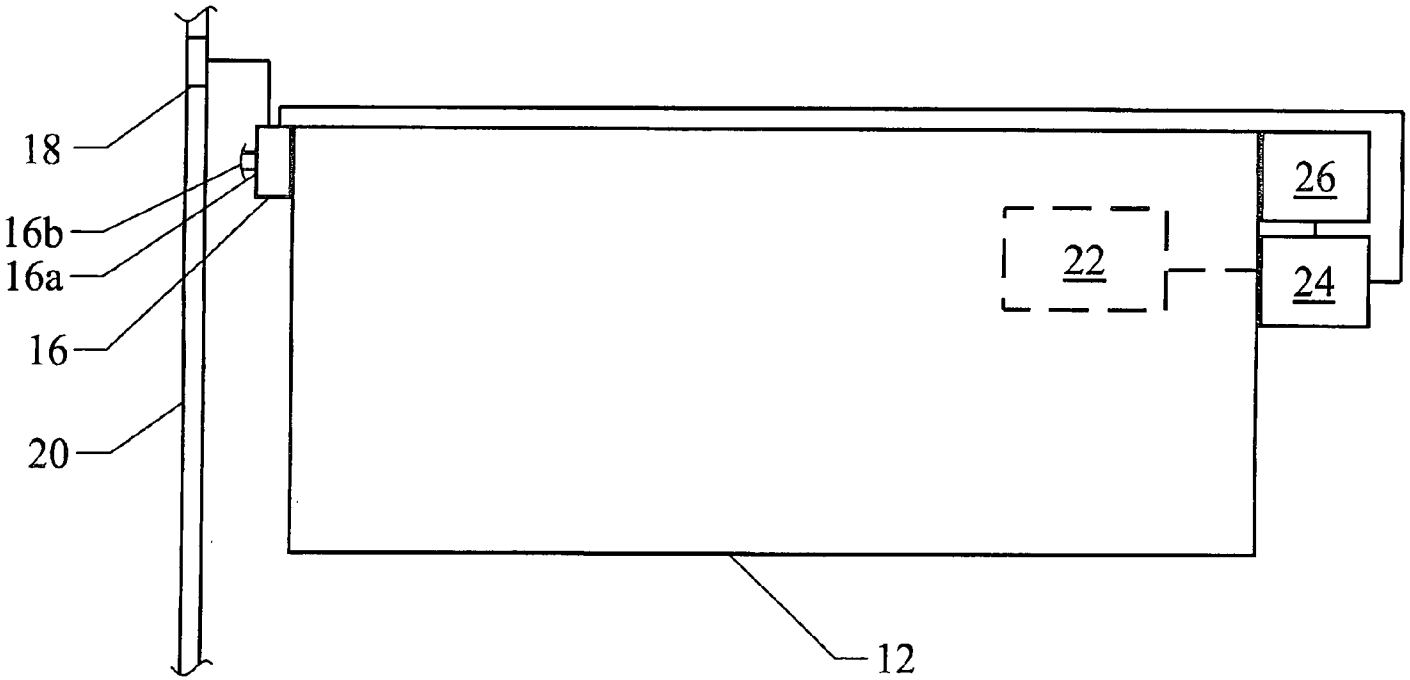
FIG. 1 is a conceptual representational schematic of one embodiment of the present invention.

Referring now to the drawings, FIGS. 1-6 disclose the present invention, which is a wall saver switch and its related method for use on a, electrically operated bed frame and is depicted generally as 10.

The invention 10 involves the attachment of a normally closed/momentarily open switch assembly 16 to an electrically operated bed frame 12 at a location 14 such that when the bed frame 12 is maneuvered or urged toward an adjacent wall surface 20, a head 16*b* of a push button switch 16*a* mounted in the assembly 16 contacts the wall surface 20 before any other part of the bed frame 12. Alternatively, head 16*b* may be a proximity sensor switch 16*a* that is activated when the sensor acknowledges the prescribed range of distance between the wall surface 20 and the head 16*b*. For purposes of simplicity each type of switch assembly 16 will be considered equivalent structure and generically push button head 16*b* is equivalent to sensor head 16*b* and push button switch 16*a* is equivalent to proximity switch 16*a*.

Most hospital bed frames 12 have bumpers near the corner of the bed frame. Therefore, a typical preferred location to mount the switch assembly 16, which is typically an electrical switch box, is where the rubber bumper is located. This can be done by removing the rubber bumper and adapting the assembly box for mounting to the location that previously held the rubber bumper. Of course, if a convenient location on the frame near the rubber bumper is available and would work just as well, then the installer can elect to attach the box at the location.

Figure 2:
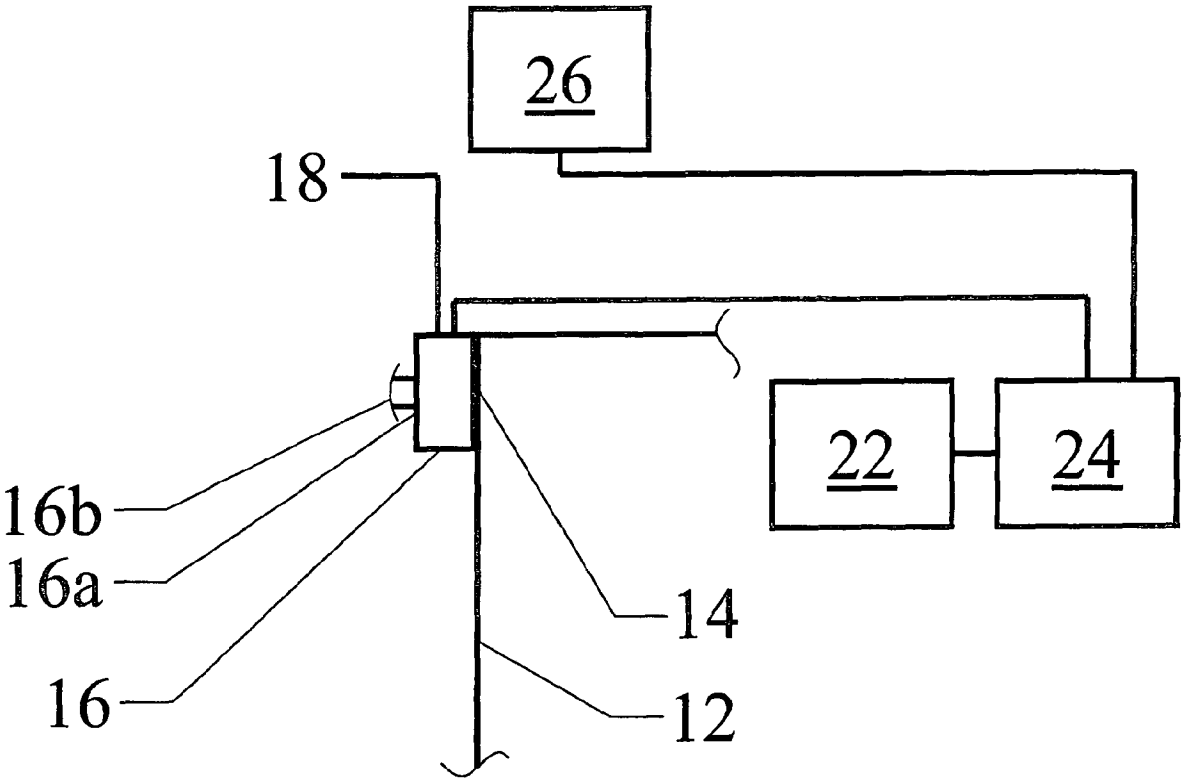
FIG. 2 is another conceptual representational schematic of the embodiment of the FIG. 1 wire scheme.
Figure 3:
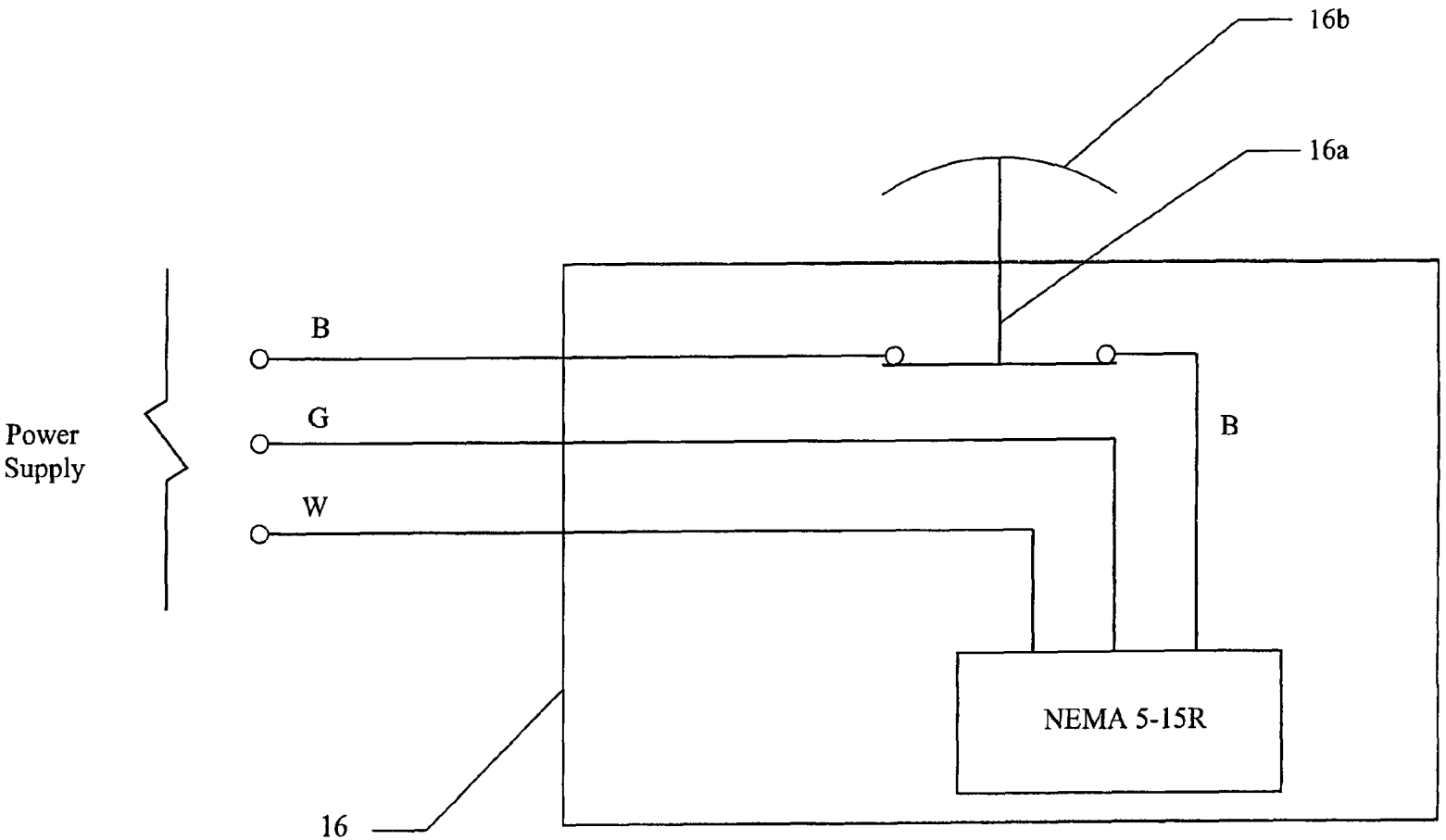
FIG. 3 is an example of a representational wire diagram/schematic of the switch assembly of the present invention for the embodiments of FIGS. 1 and 2 where the power to the bed is cut off when the switch is activated.
Figure 4:
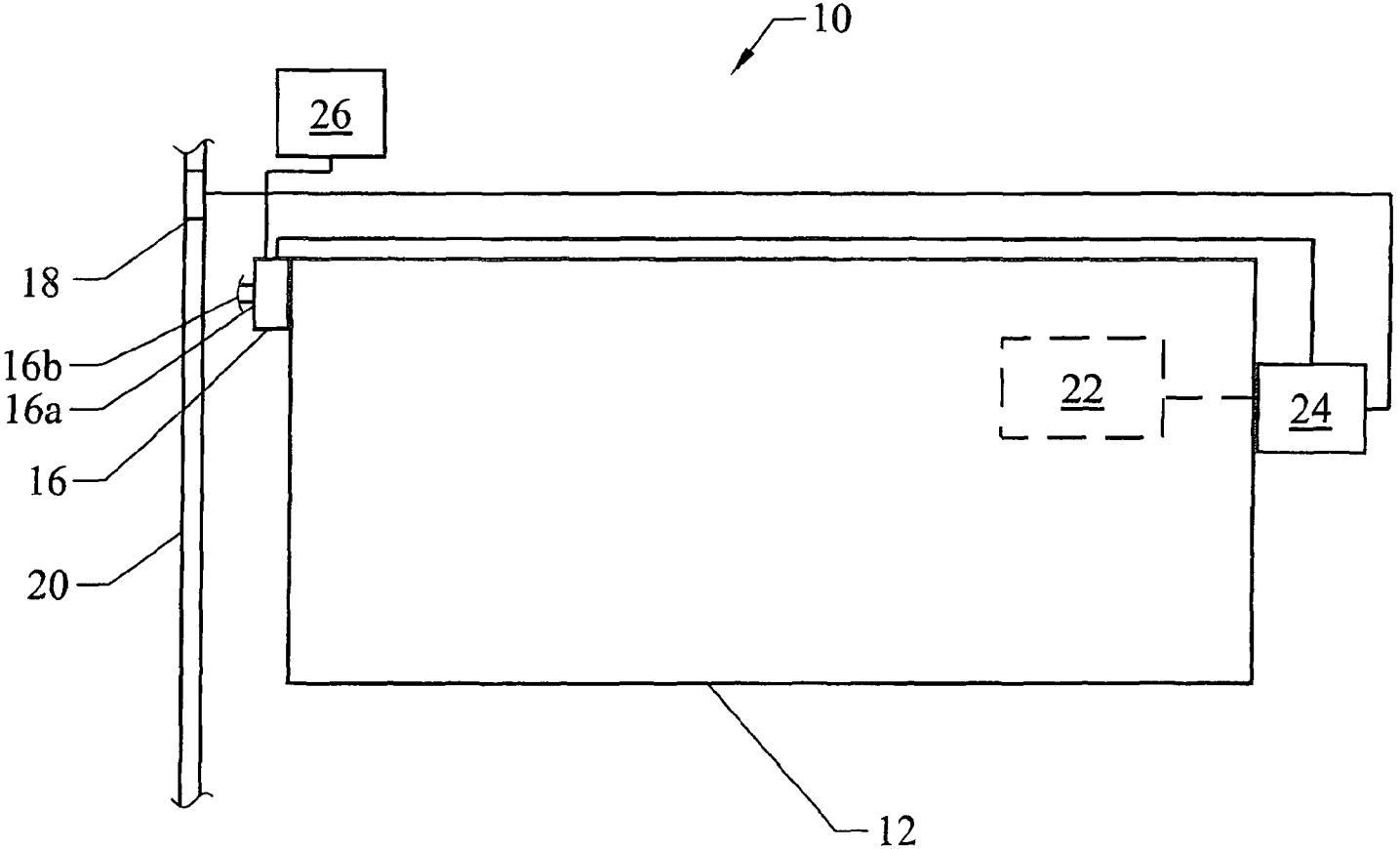
FIG. 4 is a conceptual schematic of another example of an embodiment of the present invention where the power to the system is cut off at the control panel when the switch is activated.
Figure 5:
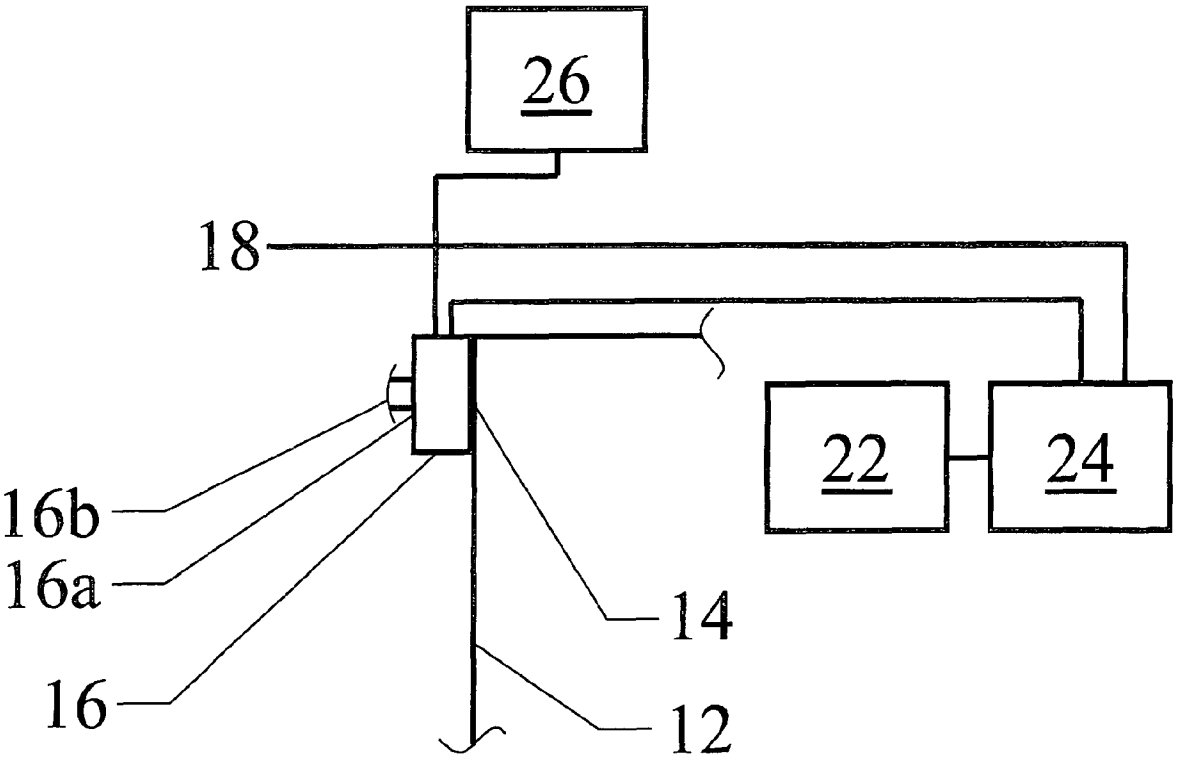
FIG. 5 is another conceptual representational schematic of the embodiment of the FIG. 4 wire scheme.
Figure 6:
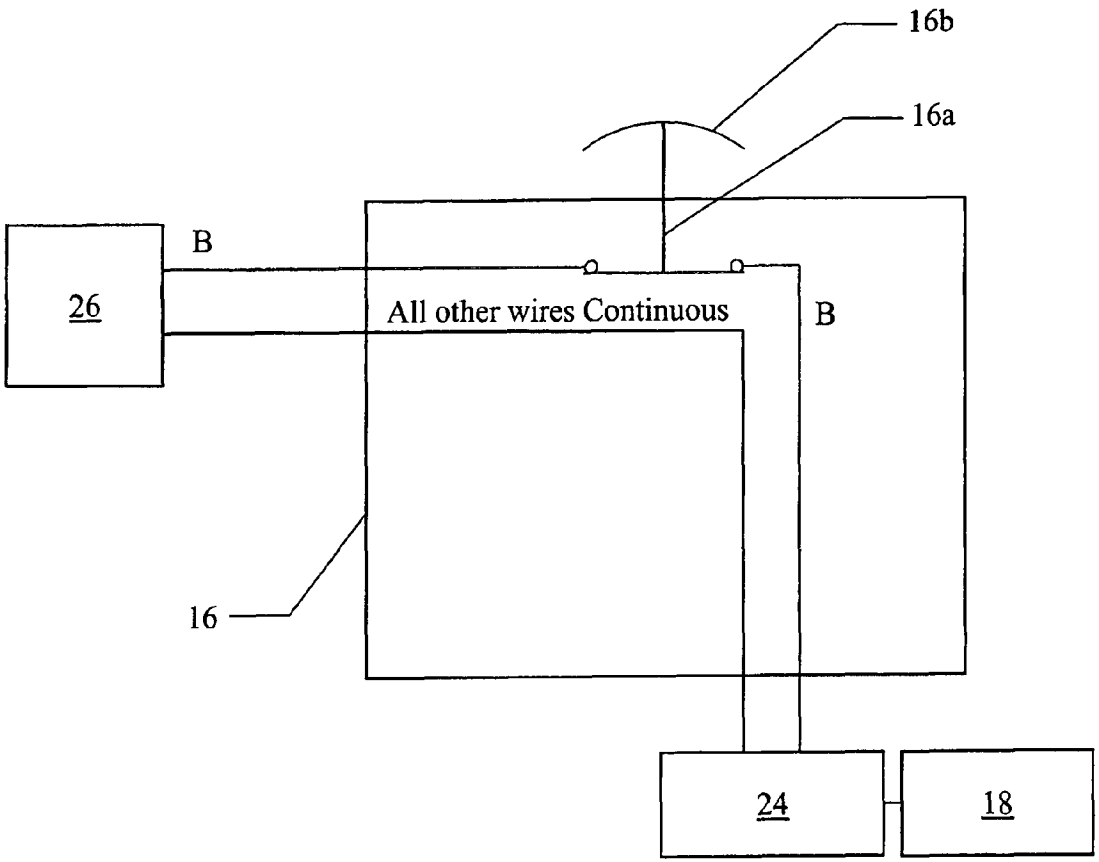
FIG. 6 is an example of a representational wire diagram/schematic of the switch assembly of the present invention for the embodiments of FIGS. 4 and 5 where the power to the control panel is cut off when the switch is activated.

The switch 16*a* is in electrical communication with a controller 26, a motor 22 and a control panel 24 typically associated with the bed frame 12 and is further in electrical communication with an electrical power source 18, which can be an AC power source from a nearby wall outlet or alternatively a DC power source if desired. FIGS. 1-3 provide examples of wiring the system where the power interruption operates so as to cut power from the power source to the bed frame. FIGS. 4-6 provide additional alternative examples of wiring the system where the communication between the controller 26 and the control panel 24 is interrupted when the switch is activated. Essentially, in FIGS. 1-3, the power cord of the circuitry of the bed frame maneuverability controls is plugged directly into the assembly 16 instead of the power source 18 and the power cord of the assembly 16 is instead plugged directly into the power source 18. In FIGS. 4-6, power from source 18 is connected directly into the control panel 24.

As shown in the drawings, there are alternative methods to integrate electrically the switch assembly 16 with the other components 22,24,26 using a power supply from all outlet 18.

When the head 16*b* of the push button switch 16*a* is depressed from its contact with the wall surface 20 or the proximity sensor head 16*b* activated the switch 16*a* so as to interrupt the current, the electrical communication with the controller 26, motor 22 and panel 24 is interrupted thereby stopping the bed frame 12 from being maneuvered any further and thereby preventing damage to the wall surface. With the push button type of switch, the depression is caused typically with little force resulting from the wall contact, so as to obtain an immediately power interruption in the circuitry of the assembly 16. Of course, it is understood that there would be no expected wall contact with a proximity sensor type of switch.

Preferably, the head 16*b* of the push button switch 16 should be a spring return mushroom head. This type of head, which is typically made from nylon material, polymeric material or even rubberized material, provides for a beveled-like edge, tapered edge or otherwise rounded edge so that if there is any damage to the wall resultant from a high force impact with the wall, any such damage hopefully will not have a sharp deep gouged area that is somewhat harder to repair.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A method for preventing damage to an adjacent wall surface of an electrically operated bed comprising:

attaching a normally closed/momentarily open switch assembly to an electrically operated bed frame at a desired location, wherein said switch assembly is in electrical communication with a controller, a motor and a control panel associated with said hospital bed frame and is further in electrical communication with one of an AC or DC power source, said motor is in electrical communication with said controller and/or said control panel such that when said switch assembly is activated from its contact with an adjacent wall surface or from its proximity to said adjacent wall surface, electrical power to said controller and/or said control panel is interrupted thereby interrupting electrically operable bed frame functions, and thereby stopping the bed frame from being maneuvered any further and thereby preventing damage to the wall surface, and wherein normal operations of the electrically operated bed frame resume when said bed frame is moved away a predetermined distance from said wall surface.

2. The method according to claim 1, wherein said switch assembly comprises a push button switch having a head of a push button switch which contacts said adjacent wall surface when said bed frame is maneuvered such that said head contacts said adjacent wall surface.

3. The method according to claim 2, wherein said head of said push button switch is a spring return mushroom head.

4. The method according to claim 1, wherein said switch assembly comprises a proximity sensor switch.

5. A system for preventing damage to an adjacent wall surface of an electrically operated bed frame comprising:

a wall saver normally closed/momentarily open switch assembly having means for attaching said switch assembly to an electrically operated bed frame at a location such that when said bed frame is maneuvered toward or contacts an adjacent wall surface, a switch of said assembly is activated so as to interrupt a circuitry between said switch assembly, a controller, a motor, a control panel associated with said bed frame and an electrical power source, said motor being in electrical communication with said controller and/or said control panel such that when said switch assembly is activated, electrical power to said controller and/or said control panel is interrupted thereby interrupting electrically operable bed frame functions, thereby stopping the bed frame from being maneuvered any further and thereby preventing damage to the wall surface, and wherein normal operations of the electrically operated bed frame resume when said bed frame is moved away a predetermined distance from said wall surface.

6. The system according to claim 5, wherein said switch assembly comprises a push button switch having a head of a push button switch which contacts said adjacent wall surface when said bed frame is maneuvered such that said head contacts said adjacent wall surface.

7. The system according to claim 6, wherein said head of said push button switch is a spring return mushroom head.

8. The system according to claim 5, wherein said switch assembly comprises a proximity sensor switch.

* * * * *